US011274018B2

(12) United States Patent
Mandy et al.

(10) Patent No.: US 11,274,018 B2
(45) Date of Patent: Mar. 15, 2022

(54) TEMPORARY AND EMERGENCY ELEVATOR INTERIOR LIGHTING ASSEMBLY

(71) Applicant: Man-D-Tec Inc., Scottsdale, AZ (US)

(72) Inventors: Terry Roy Mandy, Paradise Valley, AZ (US); Dalton John Mandy, Scottsdale, AZ (US)

(73) Assignee: MAN-D-TEC INC., Scottsdale, AZ (US)

( * ) Notice: Subject to any disclaimer, the term of this patent is extended or adjusted under 35 U.S.C. 154(b) by 0 days.

(21) Appl. No.: 16/986,216

(22) Filed: Aug. 5, 2020

(65) Prior Publication Data

US 2021/0039922 A1 Feb. 11, 2021

Related U.S. Application Data

(60) Provisional application No. 62/882,764, filed on Aug. 5, 2019.

(51) Int. Cl.

| | |
|---|---|
| ***B66B 11/02*** | (2006.01) |
| ***F21S 9/02*** | (2006.01) |
| ***B66B 19/00*** | (2006.01) |
| ***F21V 23/00*** | (2015.01) |
| *F21Y 115/10* | (2016.01) |

(52) U.S. Cl.

CPC ..... *B66B 11/0233* (2013.01); *B66B 19/00* (2013.01); *F21S 9/024* (2013.01); *F21V 23/007* (2013.01); *F21Y 2115/10* (2016.08)

(58) Field of Classification Search

CPC ..... B66B 19/00; F21V 23/007

See application file for complete search history.

(56) References Cited

U.S. PATENT DOCUMENTS

| | | | |
|---|---|---|---|
| 3,294,977 | A | 12/1966 | Duncan |
| 3,808,499 | A | 4/1974 | Edwards |
| 4,013,993 | A | 3/1977 | Mandel et al. |
| 4,056,757 | A | 11/1977 | Mauch et al. |
| 4,708,223 | A | 11/1987 | Orndorff et al. |
| 4,890,200 | A | 12/1989 | Mandy |
| 5,003,432 | A | 3/1991 | Mandy |
| 5,661,645 | A | 8/1997 | Hochstein |
| 5,739,639 | A | 4/1998 | Johnson |
| 5,966,069 | A | 10/1999 | Zmurk et al. |

(Continued)

*Primary Examiner* — Zheng Song

(74) *Attorney, Agent, or Firm* — Reising Ethington P.C.

(57) ABSTRACT

Elevator interior lighting provided by a temporary LED light fixture and power supply installed on or adjacent an elevator canopy. The temporary LED power supply comprises an LED driver and an emergency LED power supply. The LED driver connects to LEDs of the temporary LED light fixture and supplies sufficient power to provide code-compliant temporary lighting in the cab. The emergency LED power supply module connects to one or more emergency LEDs and supplies sufficient power to provide code-compliant emergency lighting in the cab upon loss of primary electrical power. To minimize costs when converting to permanent lighting, additional LED light fixtures can be added and connected to the same temporary LED power supply, and the emergency LED power module may be relocated into a down light power supply to power two or more down lights in the event of a loss of primary electrical power.

9 Claims, 5 Drawing Sheets

(56) References Cited

U.S. PATENT DOCUMENTS

| | | | | |
|---|---|---|---|---|
| 6,609,804 | B2 | 8/2003 | Nolan et al. | |
| 6,860,628 | B2 | 3/2005 | Robertson et al. | |
| 7,071,625 | B2 | 7/2006 | Cheng et al. | |
| 7,114,830 | B2 | 10/2006 | Robertson et al. | |
| 7,486,033 | B2 | 2/2009 | Chen et al. | |
| 2003/0006102 | A1* | 1/2003 | Bloch | B66B 11/0233 187/414 |
| 2008/0024010 | A1 | 1/2008 | Romano | |
| 2008/0258628 | A1 | 10/2008 | Higley et al. | |
| 2008/0296975 | A1 | 12/2008 | Shakespeare et al. | |
| 2012/0106138 | A1* | 5/2012 | Mandy | F21S 8/026 362/147 |
| 2012/0187852 | A1* | 7/2012 | Mandy | H02J 9/06 315/175 |
| 2013/0163270 | A1* | 6/2013 | Burgin | B66B 11/0233 362/544 |
| 2016/0003428 | A1* | 1/2016 | Anderson | F21S 4/26 362/147 |
| 2019/0367324 | A1* | 12/2019 | Kim | B01D 46/0036 |
| 2020/0340635 | A1* | 10/2020 | Boulanger | H05B 45/37 |

* cited by examiner

TEMPORARY AND EMERGENCY ELEVATOR INTERIOR LIGHTING ASSEMBLY

CROSS-REFERENCE TO RELATED PATENT APPLICATIONS

This application claims the benefit of U.S. Non-Provisional Application No. 62/882,763 filed Aug. 5, 2019, the entire contents of which are hereby incorporated by reference.

BACKGROUND

Field

This application relates generally to providing temporary and emergency lighting in an elevator cab.

Description of Related Art Including Information Disclosed Under 37 CFR 1.97 and 1.98

It is known, in the elevator design and installation business, to provide both temporary and/or emergency lighting in elevator cab shells before finished wall panels, drop ceilings, translucent light diffusing drop ceiling panels, and other interior furnishings and appointments are installed. The temporary lighting provides code-compliant elevator cab illumination sufficient to allow for elevator use during building construction, building renovation, interior space build-out, and/or move-in of furniture; while avoiding damage to elevator cab interior furnishings that might otherwise occur as such operations are carried-out. The emergency lighting provides code-compliant elevator cab illumination in the event a main building electrical power supply should fail during such operations.

It is also known, once building construction, renovation, interior build-out, and/or move-in operations have been completed, to remove the temporary and/or emergency lighting, and replace it with a permanent elevator cab lighting system during or after installation of elevator interior furnishings and appointments such as wall panels and a drop-ceiling. Where the drop-ceiling includes opaque ceiling panels, permanent elevator interior lighting is known to include down lighting fixtures installed in holes formed in the ceiling panels. Where the drop-ceiling includes translucent light-diffusing panels, a light source is supported above the panels and is positioned to direct light downward through the panels and into the elevator cab below. Because translucent light diffuser panels are known to block a significant amount of light, light sources positioned above such panels must emit sufficient light to allow for such blockage and still pass enough light through the panels to provide code-compliant illumination within the elevator cab.

DRAWING DESCRIPTIONS

Figure 1:
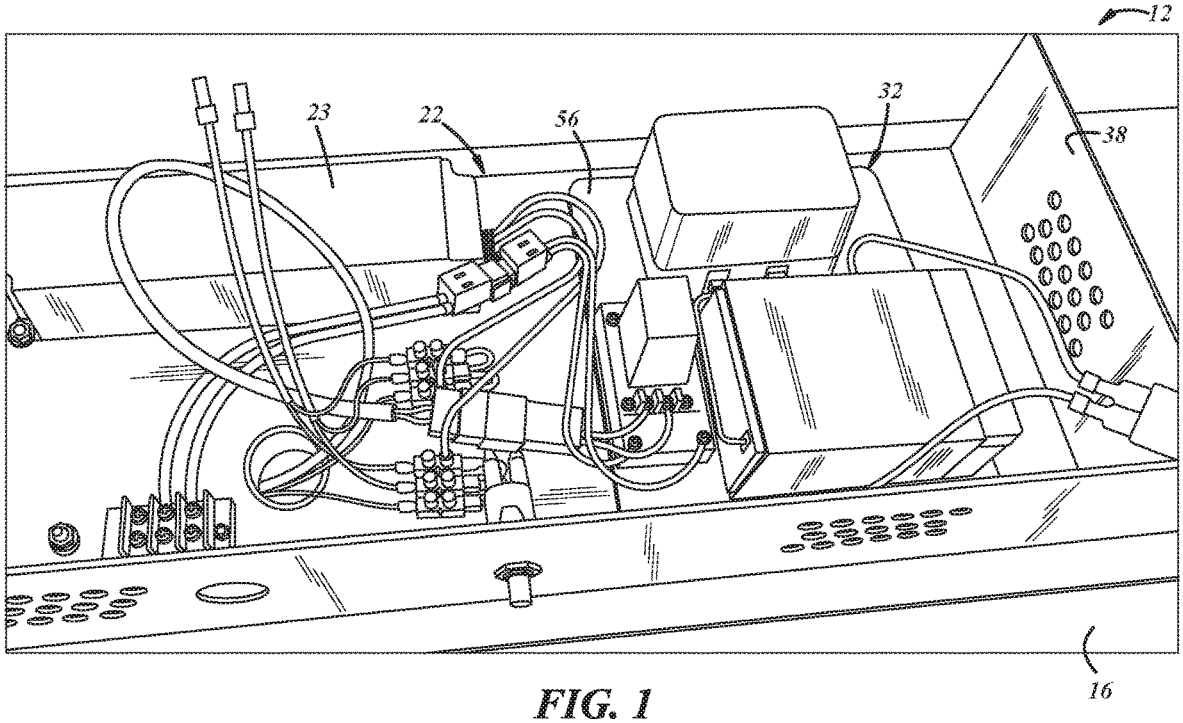
FIG. 1 is a top perspective view of a temporary power supply carrying an emergency LED power supply module.
Figure 8:
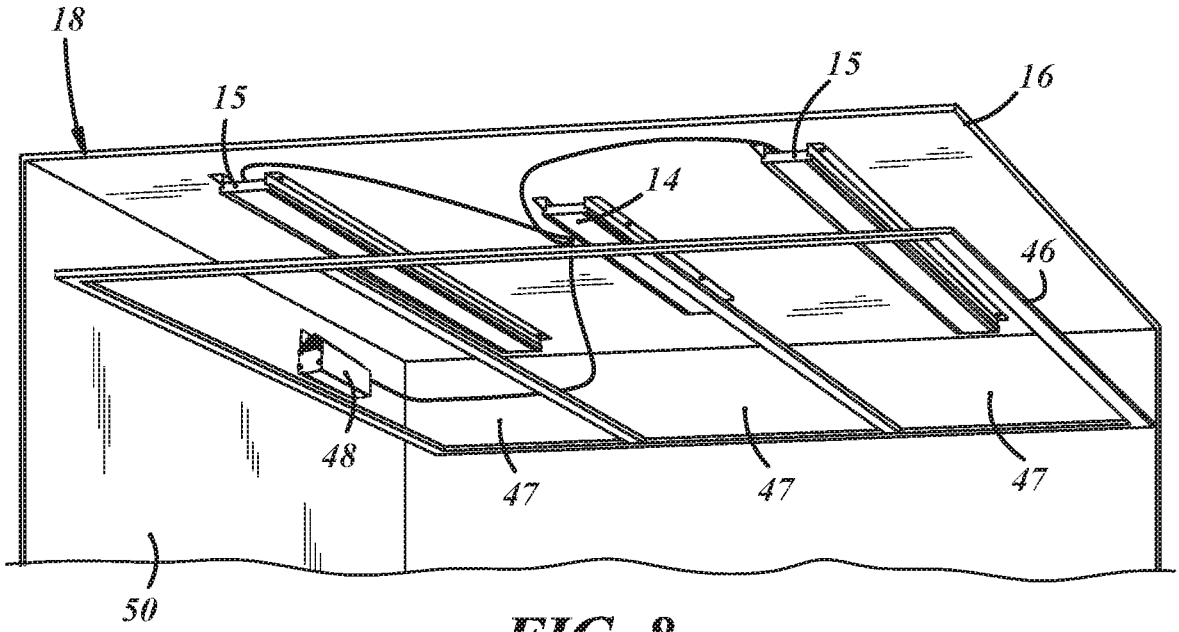
FIG. 8 is a perspective cutaway view of the temporary light fixture of FIGS. 3 and 4 as well as the emergency light fixture of FIG. 5 and additional light fixtures mounted above a translucent or diffuser drop ceiling of an elevator cab.
Figure 9:
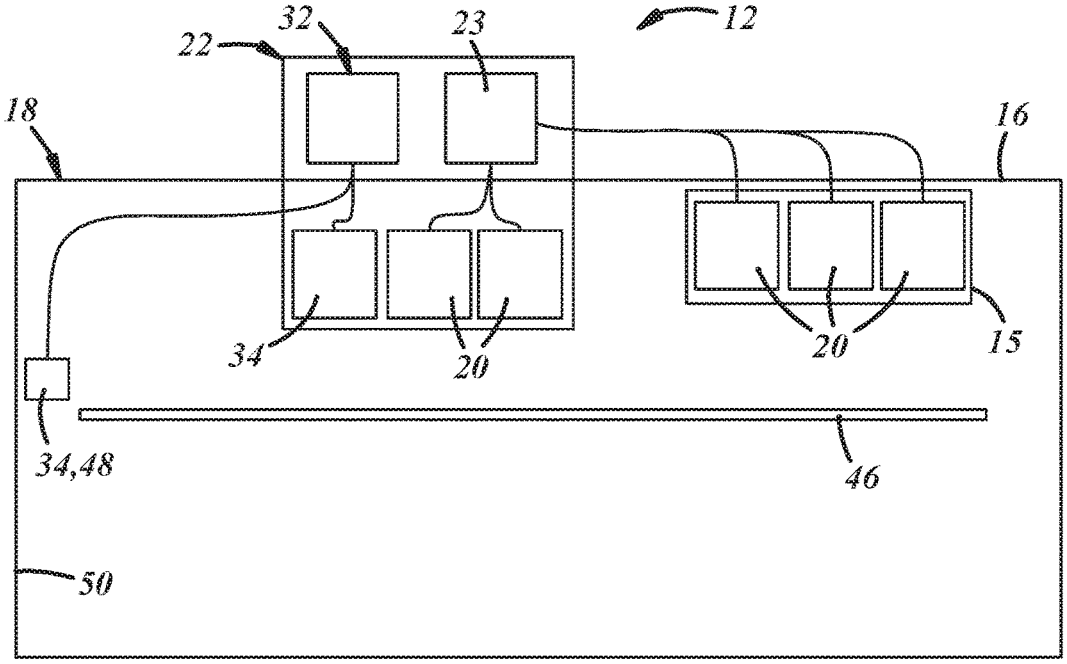
Figure 10:
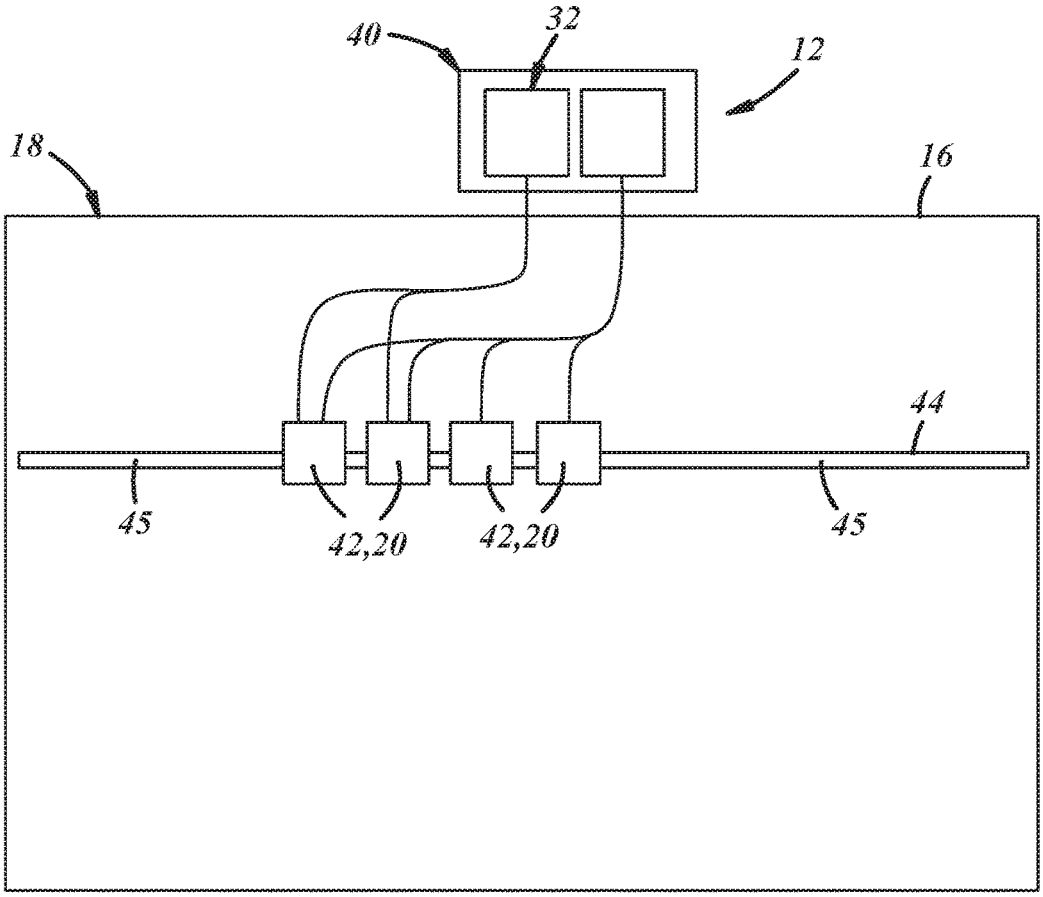

FIG. 9 is a partial schematic representation showing the approximate relative positioning of the temporary light fixture, emergency light fixture, one additional light fixture, drop ceiling, and elevator cab of FIG. 8, as well as the temporary and emergency power supplies of FIG. 1; and FIG. 10 is a partial schematic representation showing the approximate relative positioning of permanent LED downlights, an opaque drop ceiling, and the temporary and emergency power supplies of FIG. 1 in an elevator cab.

DETAILED DESCRIPTION

Figure 3:
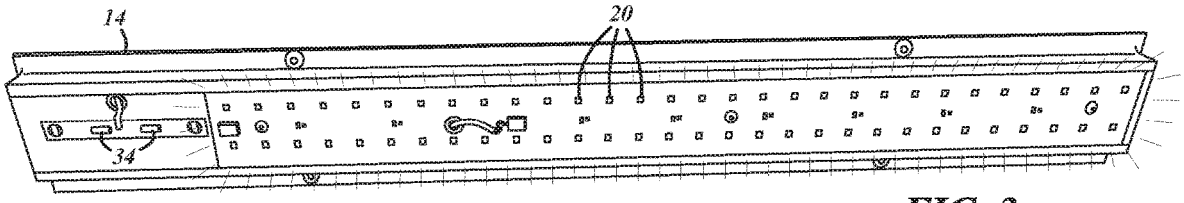
FIG. 3 is a bottom perspective view of a temporary light fixture showing only temporary LEDs lit.
Figure 4:
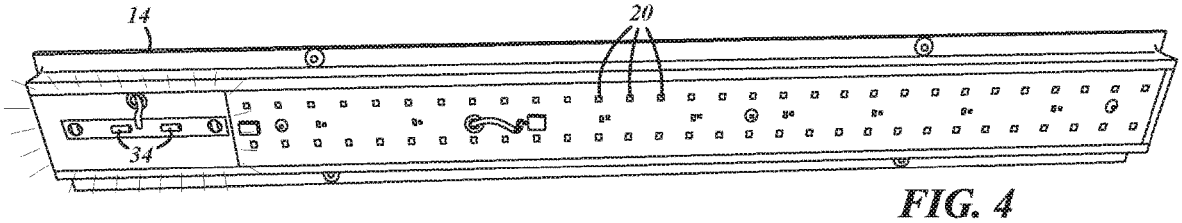
FIG. 4 is a bottom perspective view of the temporary light fixture of FIG. 3 showing only emergency LEDs lit.

A temporary and emergency elevator interior lighting assembly for illuminating an elevator interior and providing emergency lighting during building construction and build-out of interior spaces or during building renovation, is shown at 12 in the attached figures. As shown in FIGS. 3 and 4, the assembly 12 may include a temporary LED light fixture 14 for installation on an interior surface on or adjacent a canopy 16 of an elevator 18 and capable of providing sufficient illumination to provide code-compliant temporary lighting, i.e., lighting sufficient to meet code requirements for elevator interior lighting during building construction, interior space build-out, or renovation. The temporary LED light fixture 14 may include LEDs 20, which may be arranged in a string, and which may be capable of producing code-compliant temporary lighting if installed for use in the elevator 18 before any intervening translucent or opaque drop ceilings or ceiling panels are installed.

Figure 6:
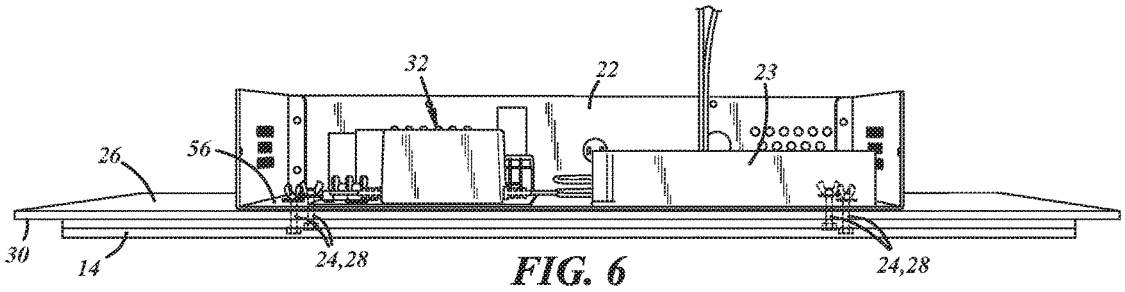
FIG. 6 is a perspective side view of the temporary power supply of FIG. 1 removably mounted to the light fixture of FIGS. 3 and 4 through an elevator canopy.

The assembly 12 may also include a temporary LED power supply 22, best shown in FIG. 1, that may be configured to be carried on the canopy 16. The temporary LED power supply 22 may comprise an LED driver connectable to LEDs 20 of the temporary LED light fixture 14 and may be configured to provide sufficient power to the LEDs 20 of the temporary LED light fixture 14 to provide code-compliant temporary lighting in the elevator 18 cab—which may require the absence of any intervening translucent or opaque drop ceilings or panels that are to be installed once construction, build-out, or renovation is complete. The temporary LED light fixture 14 may also be attachable to the temporary LED power supply 22 via fastener holes 24 or any other suitable attachment means. For example, and as shown in FIG. 6, the temporary LED power supply 22 may be mounted to a top surface 26 of the elevator canopy 16 via fasteners 28 that extend through the canopy 16 and into the temporary LED light fixture 14 mounted to a bottom surface 30 of the elevator canopy 16, thereby attaching the temporary LED power supply 22 and light fixture 14 to one another on opposite sides of the elevator canopy 16. Alternatively, the temporary LED light fixture 14 may be mounted remotely from the temporary power supply 22, or directly on a surface of the temporary power supply 22, and both may be mounted to any suitable surface of the elevator 18.

The assembly 12 may further include an emergency LED power supply module 32, that may be connectable to one or more emergency LEDs 34. The emergency LED power supply module 32 may be configured to provide sufficient power to the one or more emergency LEDs 34 to provide code-compliant emergency lighting in the elevator 18, i.e., a light level high enough to satisfy code requirements for elevator cabs during a main building electrical power supply failure, in response to loss of power from a primary electrical power source 36 such as a main building or grid electrical power source.

The emergency LED power supply module 32 may be detachably carried by the temporary LED power supply 22. This is so that, following completion of building construction or renovation, the emergency LED power supply module 32 can be electrically disconnected from the primary source of electrical power 36 and the one or more emergency LEDs 32, and mechanically disconnected and removed from a housing 38 of the temporary LED power supply 22. The emergency LED power supply module 32 may then be installed in, on, or in the general vicinity of an elevator main lighting system power supply 40, re-connected to the primary electrical power source 36, e.g., via the elevator main lighting system power supply 40, connected to one or more LEDs 20 of one or more elevator interior permanent lighting fixtures 42, and configured to power the one or more LEDs 20 of the one or more permanent elevator interior lighting fixtures 42 in response to loss of building power. This unique feature allows the emergency LED power supply module 32 to be re-used on the elevator 18 after the final installation of opaque 44 or diffuser/translucent 46 ceilings as shown in FIGS. 8-10. In the event that the final ceiling choice is a translucent diffuser ceiling 46, the LEDs 20 of the temporary LED light fixture 14 can also be re-used, along with additional light fixtures 15, to increase total light output.

Figure 2:
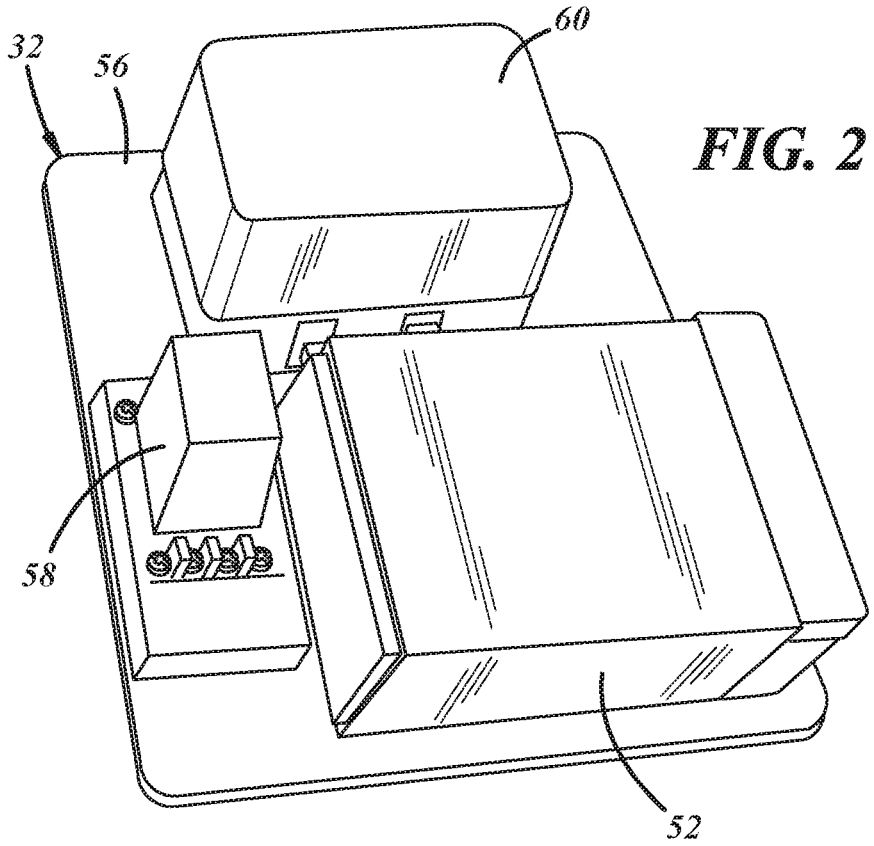
FIG. 2 is a top perspective view of the emergency LED power supply module of FIG. 1.
Figure 5:
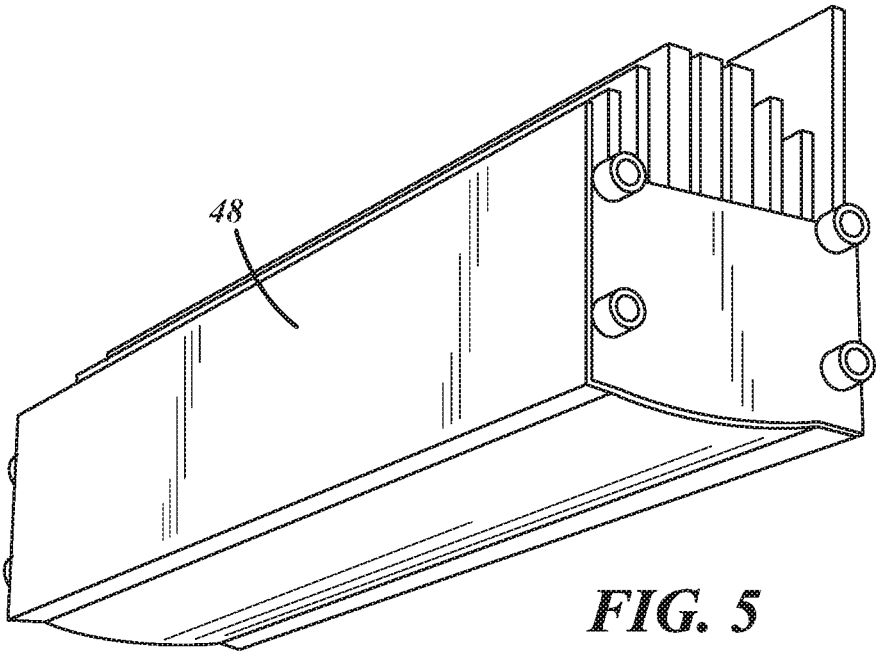
FIG. 5 is an end perspective view of an emergency light fixture.
Figure 7:
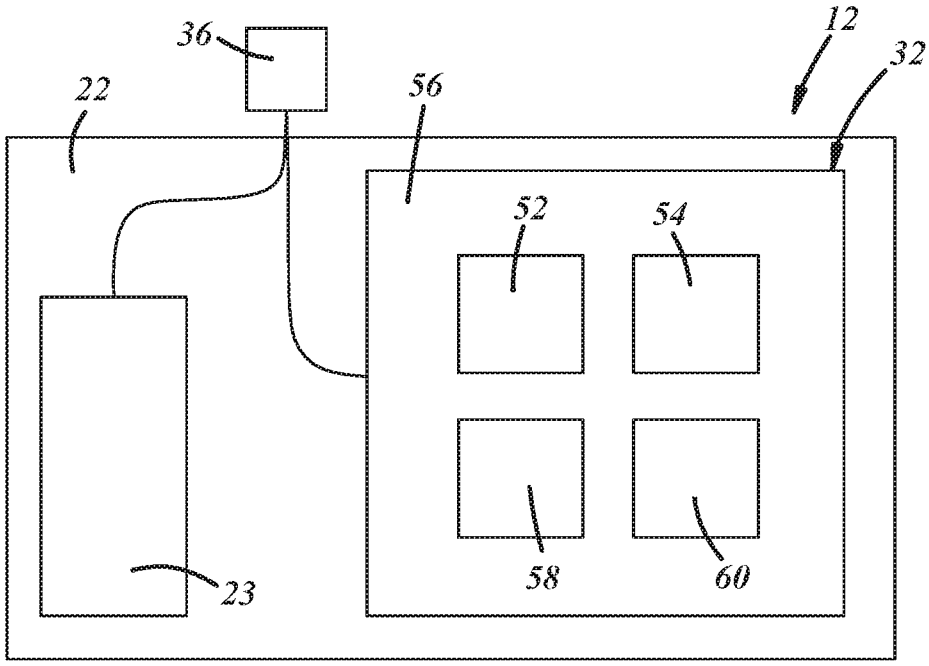
FIG. 7 is a schematic block diagram of an alternative configuration of the temporary power supply and emergency LED power supply module of FIG. 1.

As best Shown in FIGS. 2 and 7, the emergency LED power supply module 32 may include a charger 60 connected to and configured to condition power for the emergency battery 52. The emergency charger 60 and battery 52 may be carried by a common base 56 that may be detachably carried by a housing 38 of the temporary LED power supply 22. The emergency LED power supply module 32 and common base may also include at least one relay 58 or other suitable switching device(s), to allow the charger 60 to charge the battery 52 when power is available from the primary electrical power source 36, and switching to provide battery 52 power (conditioned or direct from battery) to the emergency LEDs 34 upon loss of power from the primary electrical power source 36. The emergency battery 52 may be configured to provide power to the emergency LED power supply, and the charger 60 may be configured to charge the battery 52 from any power supply (temporary or otherwise) upon which the common base is installed. An alternative embodiment of the emergency power module 32, shown in FIG. 7, may further include an emergency LED driver 54 carried by the common base 56, but this emergency driver 54 is not required in embodiments such as the one shown in FIG. 2. Compatible attachment points such as fastener holes 24, may be provided on the common base 56, the temporary LED power supply 22, and an elevator main lighting system power supply 40, so that the common base 56 (and the emergency LED power supply module 32 that it carries) may be easily moved from one power supply to the other for re-use.

The emergency LEDs 34 may be carried by the temporary LED light fixture 14, as shown in FIGS. 3 and 4, and/or may be carried by a separate emergency LED light fixture 48 that can be remotely mounted in any suitable location, as shown in FIGS. 6, 8, and 9.

In practice, the provision of code-compliant temporary illumination of an elevator interior during building construction, interior space build-out, or renovation; and the provision of emergency lighting capability both during and after building construction, interior space build-out, or renovation, can be accomplished by first installing on an interior surface, on or adjacent a canopy 16 of an elevator 18, a temporary LED light fixture 14 capable of providing sufficient illumination to provide code-compliant lighting in the elevator 18 absent any intervening translucent or opaque panels. A temporary LED power supply 22 may then be installed on the canopy 16 of the elevator 18 by connecting an LED driver 23 of the temporary LED power supply 22 to one or more LEDs of the temporary LED light fixture 14 and connecting an emergency LED power supply module 32 mounted in the temporary LED power supply 22 to one or more emergency LEDs 34.

The temporary LED power supply 22 installed by this method may be configured to provide sufficient power to the LEDs of the temporary LED light fixture 14 to provide code-compliant temporary lighting in the cab. The emergency LED power supply module 32 installed according to this method may also be configured to provide sufficient power to the one or more emergency LEDs 34 to provide code-compliant emergency lighting in the cab in response to loss of building power. The one or more emergency LEDs 34 to which the emergency LED power supply module 32 is connected may mounted in the temporary LED light fixture 14, or may, alternatively or additionally, be mounted in one or more emergency light fixtures 48 separate from the temporary LED light fixture 14. The temporary LED power supply 22 may use an oversized transformer/LED driver 23 to accommodate this future expansion.

Where the method includes installing an opaque drop-ceiling 44 in the elevator 18, as shown in FIG. 10, the opaque drop ceiling 44 may comprise a plurality of opaque drop-ceiling panels 45. The temporary LED light fixture 14 may be removed from the temporary power supply 22, and permanent lighting fixtures 42 installed either before or after drop-ceiling panel installation. The permanent lighting fixtures 42 may be down-lighting fixtures that may be carried by the drop ceiling 44 and positioned to emit light into the elevator 18 cab through corresponding openings in the drop ceiling 44 as shown in FIG. 10. The temporary power supply 22 may be replaced with an elevator main lighting system power supply 40. The emergency LED power supply may then be connected to the elevator main lighting system power supply 40. The emergency LED power supply module 32 may also be connected to at least one, and preferably two of the down-lighting fixtures 42 so that code-compliant emergency illumination can be provided in the elevator cab 18 by the same emergency LED power supply module 32 used during construction, interior build-out, or renovation.

Where the method includes installing a translucent and/or diffuser drop-ceiling 46 in the elevator 18, the drop-ceiling installation may include installing one or more translucent light diffuser panels 47 to allow light to be transmitted into the cab from above, as shown in FIGS. 8 and 9. To ensure that sufficient light passes through the translucent light diffuser panels 47, additional LED fixtures 15 may be installed in the elevator 18 above the position where the translucent/diffuser drop-ceiling 46 is to be installed, and connected to the temporary LED power supply 22. The additional LED fixtures 15 may be sufficient to emit, along with the temporary LED light fixture 14, sufficient light to ensure that sufficient illumination passes through the one or more translucent light diffuser panels 47 to provide code-compliant lighting in the elevator cab 18. Where code-compliant lighting is achieved, and if the translucent/diffuser drop ceiling 46 is intended to be permanent, then the temporary LED power supply 22 may be left in place for permanent use.

Sufficient code-compliant emergency, temporary, and general lighting may be determined according to the standards set by ASME 17.5 (or its effective successors and equivalents). For example, to meet current ASME standards, emergency fixtures 34 may be added until at least 0.2 Foot Candles (FC), measured 1 foot out and 4 feet off the floor, are provided by the emergency lighting. And additional LED fixtures may be added for general lighting until at least 5 Foot Candles (FC) are provided at the elevator's threshold with the doors closed. Specific quantities and types of lights added may vary to meet variations in code across time and jurisdiction.

The emergency LED power supply module 32, when mounted on the temporary power supply 22, may be connected to one or more emergency LEDs 34 of an emergency light fixture 48 that may be supported in a position to illuminate the elevator 18 cab without passing through the translucent light diffuser panels 47 or opaque drop ceiling 44. For example, the emergency light fixture 48 may be mounted to a wall 50 of the elevator 18 adjacent a gap between the elevator wall 50 and the translucent light diffuser panels 47, as shown in FIGS. 8 and 9, and aimed to illuminate the elevator's call buttons or any other desired portion of the elevator 18. A similar emergency light fixture 48 positioning could also be used for the opaque drop ceiling 44 shown in FIG. 10. Positioning an emergency light fixture 48 in this way can provide code-compliant emergency lighting in the elevator 18 cab using less power than would be required if the light had to pass through one or more translucent light diffuser panels 47.

This description, rather than describing limitations of an invention, only illustrates embodiments of the invention recited in the claims. The language of this description is therefore exclusively descriptive and is non-limiting. Obviously, it's possible to modify this invention from what the description teaches. Within the scope of the claims, one may practice the invention other than as described above.

What is claimed is:

1. A method for providing temporary and emergency lighting in an elevator interior; the method comprising the steps of:

installing a temporary LED light fixture in an elevator, the temporary LED light fixture being capable of providing sufficient illumination to provide code-compliant lighting in the elevator; and installing a temporary LED power supply on the elevator by:

connecting and configuring an LED driver of the temporary LED power supply to provide sufficient power to one or more LEDs of the temporary LED light fixture to provide code-compliant temporary lighting in the cab, and connecting and configuring an emergency LED power supply module in the temporary power supply to provide sufficient power to one or more emergency LEDs to provide code-compliant emergency lighting in the cab in response to loss of building power.

2. A method for providing temporary and emergency lighting in an elevator interior; the method comprising the steps of:

installing a temporary LED light fixture in an elevator, the temporary LED light fixture being capable of providing sufficient illumination to provide code-compliant lighting in the elevator; and installing a temporary LED power supply on the elevator by:

connecting and configuring an LED driver of the temporary LED power supply to provide sufficient power to one or more LEDs of the temporary LED light fixture to provide code-compliant temporary lighting in the cab, and connecting and configuring an emergency LED power supply module in the temporary power supply to provide sufficient power to one or more emergency LEDs to provide code-compliant emergency lighting in the cab in response to loss of building power;

disconnecting the emergency LED power supply module from the one or more emergency LEDs;

removing the emergency LED power supply module from the temporary LED power supply; and connecting and configuring the emergency LED power supply module to power one or more LEDs of one or more permanent elevator interior lighting fixtures in response to loss of electrical power from a primary source of electrical power.

3. The method of claim 1 including the additional step of converting the temporary LED light fixture to permanent lighting by connecting additional LED fixtures to the temporary power supply until enough LED fixtures are installed to provide code compliant light levels.

4. The method of claim 2 in which the step of removing the emergency power supply module from the temporary power supply comprises detaching the emergency LED power supply module via a common base detachably carried by the temporary LED power supply and attachable to be carried within an elevator main lighting system power supply; and including the additional step of installing the emergency LED power supply module in an elevator main lighting system power supply via the common base.

5. The method of claim 2 in which the step of connecting and configuring an emergency LED power supply module to power one or more emergency LEDs includes connecting and configuring the emergency LED power supply module to power one or more LEDs of the temporary LED light fixture.

6. The method of claim 2 in which the step of connecting and configuring an emergency LED power supply module to power one or more emergency LEDs includes connecting and configuring the emergency LED power supply module to power one or more LEDs of an emergency light fixture.

7. A method for providing temporary and emergency lighting in an elevator interior; the method comprising the steps of:

installing a temporary LED light fixture in an elevator, the temporary LED light fixture being capable of providing sufficient illumination to provide code-compliant lighting in the elevator; and installing a temporary LED power supply on the elevator by:

connecting and configuring an LED driver of the temporary LED power supply to provide sufficient power to one or more LEDs of the temporary LED light fixture to provide code-compliant temporary lighting in the cab, and connecting and configuring an emergency LED power supply module in the temporary power supply to provide sufficient power to one or more emergency LEDs to provide code-compliant emergency lighting in the cab in response to loss of building power;

installing permanent lighting comprising down-lighting fixtures positioned above the drop-ceiling and oriented to emit light into the elevator cab through corresponding openings in the drop ceiling; and connecting and configuring the emergency LED power supply to power at least one of the down-lighting fixtures.

8. A method for providing temporary and emergency lighting in an elevator interior; the method comprising the steps of:

installing a temporary LED light fixture in an elevator, the temporary LED light fixture being capable of providing sufficient illumination to provide code-compliant lighting in the elevator; and installing a temporary LED power supply on the elevator by:

connecting and configuring an LED driver of the temporary LED power supply to provide sufficient power to one or more LEDs of the temporary LED light fixture to provide code-compliant temporary lighting in the cab, and connecting and configuring an emergency LED power supply module in the temporary power supply to provide sufficient power to one or more emergency LEDs to provide code-compliant emergency lighting in the cab in response to loss of building power;

installing a drop-ceiling in the elevator, the drop-ceiling comprising at least one translucent light diffuser panel;

installing in the elevator and above the drop-ceiling, and connecting to the temporary LED power supply, additional LED fixture(s) sufficient to emit, along with the temporary LED light fixture, sufficient light through at least one translucent light diffuser panel to provide code-compliant lighting in the elevator cab.

9. The method of claim 8 including the additional step of connecting and configuring the emergency LED power supply module to power one or more LEDs of an emergency light fixture.

* * * * *